US008932104B2

(12) United States Patent
Moylan

(10) Patent No.: US 8,932,104 B2
(45) Date of Patent: Jan. 13, 2015

(54) SPORTS BRA

(76) Inventor: Sara Marie Moylan, Jenison, MI (US)

( * ) Notice: Subject to any disclaimer, the term of this patent is extended or adjusted under 35 U.S.C. 154(b) by 196 days.

(21) Appl. No.: 13/506,787

(22) Filed: May 17, 2012

(65) Prior Publication Data

US 2012/0302137 A1 Nov. 29, 2012

Related U.S. Application Data

(60) Provisional application No. 61/519,532, filed on May 24, 2011.

(51) Int. Cl.
*A41C 3/00* (2006.01)

(52) U.S. Cl.
CPC ..... *A41C 3/0057* (2013.01)
USPC ..... 450/86; 450/23; 450/79; 450/83

(58) Field of Classification Search
USPC ..... 450/85, 86, 88, 76, 15, 16, 25, 23, 58, 450/79, 83
See application file for complete search history.

(56) References Cited

U.S. PATENT DOCUMENTS

| | | | | |
|---|---|---|---|---|
| 525,241 | A | 8/1894 | Tucek | |
| 719,075 | A | 1/1903 | Beeman | |
| 2,156,478 | A | 5/1939 | Kemp | |
| 2,455,036 | A * | 11/1948 | Boylan | 450/86 |
| 2,521,373 | A * | 9/1950 | Hutchison | 450/77 |
| 4,607,640 | A | 8/1986 | McCusker | |
| 5,221,227 | A | 6/1993 | Michels | |
| 6,293,844 | B1 | 9/2001 | Dalton | |
| 6,422,917 | B1 | 7/2002 | Rose et al. | |
| 7,144,294 | B2 * | 12/2006 | Bell et al. | 450/20 |
| 7,549,971 | B2 * | 6/2009 | Bell et al. | 602/75 |
| 7,931,521 | B1 * | 4/2011 | Griffin | 450/86 |
| 8,167,679 | B2 * | 5/2012 | Seraceno et al. | 450/86 |
| 8,172,639 | B2 * | 5/2012 | Swendseid | 450/85 |
| 8,267,740 | B1 * | 9/2012 | Afxentiou | 450/86 |
| 8,317,569 | B2 * | 11/2012 | Fisher-Pacheco | 450/79 |
| 8,323,070 | B2 * | 12/2012 | Abbaszadeh | 450/36 |
| 2003/0166375 | A1 | 9/2003 | Noel et al. | |
| 2010/0190411 | A1 * | 7/2010 | Saraceno et al. | 450/39 |
| 2011/0177757 | A1 * | 7/2011 | Swendseid | 450/70 |
| 2011/0269375 | A1 * | 11/2011 | Fisher-Pacheco | 450/57 |

* cited by examiner

*Primary Examiner* — Gloria Hale
(74) *Attorney, Agent, or Firm* — Waters & Oppenhuizen PLC; John A. Waters

(57) ABSTRACT

A one piece sports bra with a maximally adjustable back strap and two maximally adjustable shoulder straps of substantially elastic hook and loop material. The back straps can be attached to hardware atop breast two covers and worn in a crisscross or conventional pattern.

7 Claims, 1 Drawing Sheet

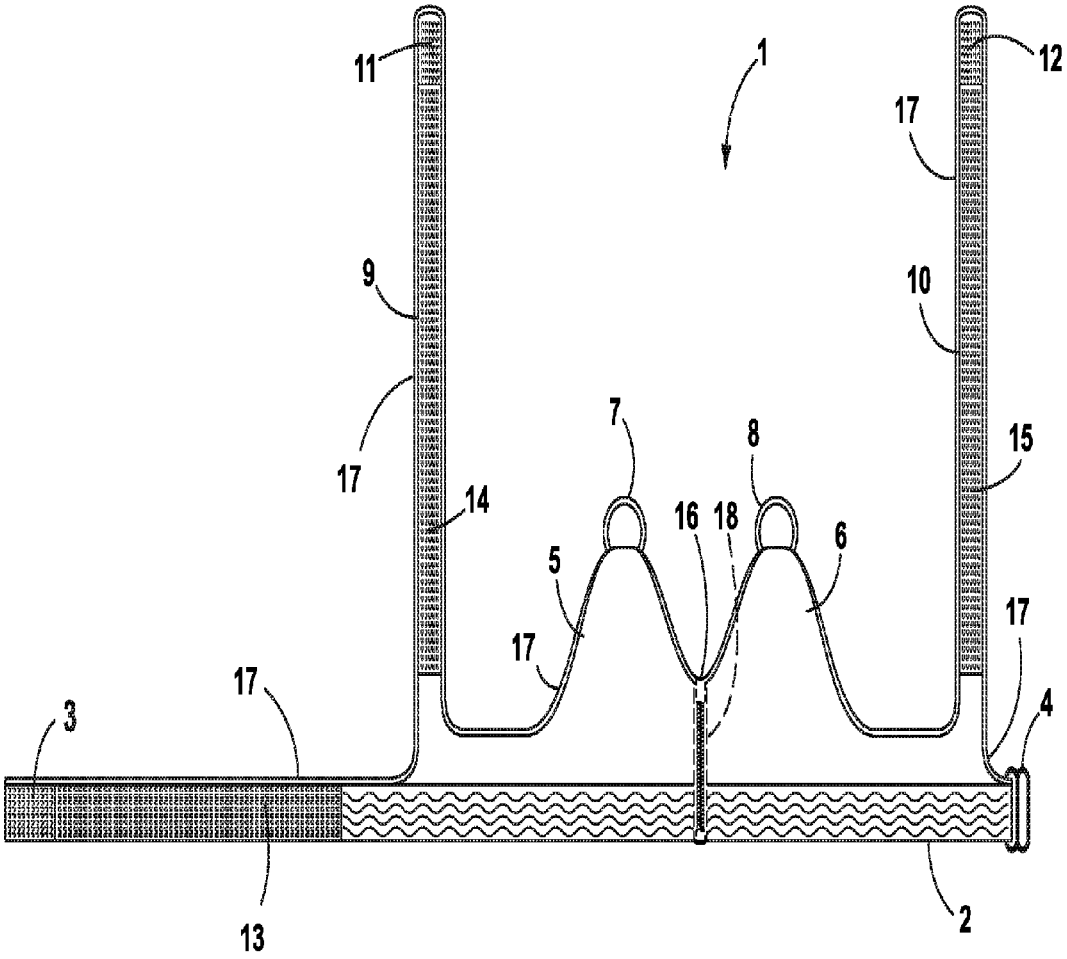
1
2
3
4
5
6
7
8
9
10
11
12
13
14
15
16
17
18

SPORTS BRA

This application claims the benefit of the filing of U.S. Provisional Application No. 61/519,532 entitled Sports Bra filed on May 24, 2011 and the specification thereof is incorporated herein by reference.

FIELD OF THE INVENTION

This invention relates to a brassiere especially useful for physically active women, commonly referred to as a sports bra.

BACKGROUND OF INVENTION

Conventional brassieres, commonly referred to as bras, consist of two breast covers, commonly referred to as cups, fastened to the upper body of a woman using a back strap and two shoulder straps. Some of the straps of commonly available bras are adjustable but only to a limited and/or pre-set amount. Since women vary greatly in their chest and breast sizes and also in the amount of physical activity they engage in, it is desirable to provide a bra that is flexible enough to easily satisfy the immediate needs of women of various sizes who engage in varying levels and kinds of physical activity.

U.S. Pat. Nos. 6,422,917 and 6,293,844 contain a summary of the prior art relating to brassieres which is incorporated herein by reference. None, including the more recent publication US 2003/0166375, have the most essential feature of the present invention namely the hardware located at the apex of the cups, most especially in combination with the other features of the present invention.

BRIEF SUMMARY OF THE INVENTION

The present invention relates to a bra that provides a wide range of flexibility to quickly and easily achieve maximum comfort at the discretion of the user regardless of the intended level of her physical activity level. It is most useful in addressing the problem of breast discomfort experienced by physically active women. Most especially it provides the desired level of support for their breasts while they engage in physically demanding activities. By allowing greater flexibility in easily fitting her bra, a woman can achieve the amount of compression, support and comfortable fit she wants or needs. This flexibility and support is achieved by providing back and shoulder straps that can be tightened or loosened individually and, with respect to the shoulder straps, can be fastened in two different ways, all to an essentially unlimited extent by using hook and loop technology and ringed hardware.

The term "back strap" or "bust strap" as used herein refers to the horizontal strap used to fasten a bra to a user's body and is not limited to a strap or portion of a strap that extends only over the back area of the body. This strap is also referred to herein as a "body strap".

The bra of the present invention employs two types of hardware. The word "hardware" as used in this specification refers to hard circular or oblong objects containing at least one opening. The hardware affixed to the tops or apexes of the breast cups as shown in the attached drawing has one opening and is shaped like a key ring but could be oblong instead. The hardware affixed to one end of the back strap as shown in the drawings is shaped like a figure-8 flattened from top to bottom resulting in two connected essentially oblong side by side openings, one opening used to permanently affix the hardware to the back strap and the other opening used to accommodate the hook end of the back strap when the back strap is fastened and/or tightened by the user. However the hardware can also be rectangular instead of rounded, albeit the rounded forms as shown are more readily available commercially and work adequately. It could also provide a single opening but would invite more wear and tear during use.

Thus the bra of the present invention comprises a back or bust strap and two shoulder straps fastened to the fabric containing the breast cups. It can be fitted on a woman by connecting the ends of the back strap to each other and affixing the free ends of the shoulder straps to the tops or apexes of the breast cups. Hook and loop technology, commercially available under the trademark VELCRO, is the preferred means of connecting and/or tightening the free ends of the three straps. The preferred fabric for the free ends of the back and shoulder straps is compatible with hook and loop technology which is not flexible while the balance of the fabric can be composed of flexible material, e.g., the commercially available fabric sold under the trademark, Velstrech. This fabric can be replaced, especially around the girth (under the breast) is preferably a heavy duty athletic, preferably wickable, elastic fabric. One or loose end of the back strap and the loose ends of the shoulder straps provide a hook surface and a large part of the remainder of the fabric used for the straps consists of a loop surface. Thus, for example, by employing a ring of hard material like plastic or metal affixed to the tops or apexes of the breast cups, the shoulder straps can be passed through the rings and folded back over themselves so the hook end of the straps is affixed to the loop portions of the straps. Likewise the hook end of the back strap can be passed through an opening in the hardware affixed to the other end of the back strap and then folded back over itself and affixed to the loop portion of the back strap. The shoulder straps can be attached to the cup rings either in a crisscross manner so the free end of each shoulder strap on one side of the bra is attached to the breast cup on the other side of the bra. The bra is flexible enough so the shoulder straps can also be connected in the conventional manner, i.e., straight up with each shoulder strap attached to the ring located closest to the strap. In each case a strap can be tightened or loosened at the pleasure of the wearer. The shoulder straps can be adjusted before or after the bra is put on, albeit more precision in the degree of firmness can be achieved during the period the bra is worn. The back strap is best adjusted to the desired tightness after the bra is fitted over the arms and shoulders and during wear to match the activity level the wearer is engaged in.

Expressed broadly the brassiere of the present invention comprises a. two breast covers or cups connected to each other and at their lower surfaces to a back strap,
b. the back strap having a loose end and a fixed end, the loose end consisting largely of hook and loop material adapted to circle the body of a woman wearing the brassiere and connecting to openings in hardware at the fixed end, and
c. two shoulder straps, each having a loose end and a fixed end, the fixed end connected to the brassiere outside the breast covers and the free ends consisting largely of hook and loop material and adapted to connect separately to openings in hardware fastened atop the breast covers.

Since the loose ends of the shoulder straps and back strap consist almost entirely of hook and loop material the wearer of the brassiere can have maximum flexibility to quickly and easily adjust the bra to suit her own comfort and the intensity of the activity she is engaging in at the time she makes the adjustment.

More specifically, the present invention is a maximally adjustable brassiere comprising a) left and right breast covers, b) a back strap having a first section, a second section, and a third section c) left and right shoulder straps, each having a first end and a second end, and d) a first, second and third piece of hardware Wherein a. the first section of the back strap is attached to and located below the breast covers, the second section is attached at one end to the first section of the back strap and extends outward first with loop material and ends with hook material, and the third section is attached at one end to the first section and ends with the first piece of hardware suitable for attachment to the second section using its hook and loop material, b. the first ends of the left and right shoulder straps are attached to and located equidistant outside the left and right breast cups over the back strap and extend outward first with loop material and end toward the second end with hook material, and c. the second and third pieces of hardware are attached atop the breast covers and provide an opening that is large enough to allow the free end of the shoulder straps to pass through them for attachment to the loop surface of the shoulder straps.

BRIEF DESCRIPTION OF DRAWINGS

The FIGURE is a frontal view of the laid out bra.

LIST OF REFERENCE NUMERALS

1 Bra
2 Back strap
3 Hook end of back strap
4 Hardware end of back strap
5 First breast cup
6 Second breast cup
7 Ring fastened over the first breast cup
8 Ring fastened over the second breast cup
9 First shoulder strap
10 Second shoulder strap
11 Hook end of first shoulder strap
12 Hook end of second shoulder strap
13 Loop portion of back strap
14 Loop portion of first shoulder strap
15 Loop portion of second shoulder strap
16 Neckline
17 Trim

DETAILED DISCLOSURE OF INVENTION

Best Mode of Carrying Out Invention

The bra 1 of the present invention as shown in the FIGURE can be produced using conventional methods well known to those skilled in the art of manufacturing bras, albeit in this case the materials selected must in part be compatible with hook and loop technology like that sold commercially under the trademark Velcro. The fabric most suitable for parts other than the hook and loop portions of the back 2 and shoulder straps 9,10 is available commercially under the trademark Velstretch but any heavy duty athletic, preferably wickable, elastic can be used. The back strap 2 has a hook surface 3 at one end and hardware 4 affixed to the other end. Likewise the two shoulder straps 9,10 have a hook surface 11,12 at their free ends and a loop surface 14,15. Exclusive of the hook and loop portions, the bra 1, including the breast cups 5,6, is preferably made from a stretchable power knit material used in sport ware such as, for example, the commercially available fabrics sold under the trademarks COOLMAX, POWERLYCRA or LYCRA. Fabric liners of two types can be used for the breast cups, a non-stretch foam molded wickable fabric or a non-stretchable polyester sport blend. Rings of hard plastic or metal material 7,8 are affixed over the tops or apexes of the cups 5,6. O rings from 1 to 1.5 inch in diameter can be used, the specific size depending on the size of the bra. The most essential feature of the hardware, other than ability to withstand the wear and tear of usage, is an opening large enough to allow the hook and loop fabric to pass through them easily.

The neckline 16 can be either a high or scoop shape. The FIGURE displays a scoop shape. The area between the cups 5, 6 can include a zipper 18 (shown in phantom) that extends through the back strap 2 if desired. The back strap 2 is preferably about two inches wide. The shoulder straps 9, 10 are preferably about half that width. The lengths of the straps and sizes of the cups along with the bra 1 as a whole can be varied to accommodate women of all sizes, albeit the straps should be relatively longer than usual in conventional bras to provide the maximum variation in tightness to suit the wishes of the wearer. The hardware for the back strap 2 is preferably a 2 inch OO, i.e., two flattened Os fused together at their narrow sides to form two connected ovals.

The fabric can be trimmed as shown 17 by heat sealing or by using a non-stretchable athletic fabric as long as the resulting trim does not stretch.

Although the invention has been described in the foregoing detail with respect to preferred embodiments, other embodiments can achieve the same results. Variations and modifications of the present invention will be obvious to those skilled in the same art and are intended to be covered in the appended claims. The entire disclosures of all references, applications, patents and publications cited above are hereby incorporated by reference.

The invention claimed is:

1. A brassiere comprising:

two laterally spaced breast cups having upper and lower edges and inner and outer side edges, the upper edges of the cups including shoulder strap attachment rings for attaching shoulder straps at the upper edges of the breast cups;

a body strap attached to the lower edges of the breast cups and having a first section extending under the breast cups and an elongated second section that extends laterally outwardly from the first section on one side of the breast cups to a free end that extends around the body of a wearer, the second section of the body strap having hook and loop fastener material affixed to an elongated portion thereof, the body strap having a third section connected to the first section on an opposite side of the breast cups from the second section and extending laterally outwardly therefrom, the third section including a first piece of hardware in the form of a body strap attachment ring attached thereto, the second section of the body strap fitting around the wearer's body and through the body strap attachment ring to fasten the brassiere on the wearer's body, the hook and loop fastener material being affixed to the second section of the strap at spaced locations thereon, with the loop material being affixed to an elongated portion of the strap inward from the outer end and the hook material being attached toward the free end of the strap, such that when the strap is extended through the attachment ring and folded back against itself, the hook material is engaged with and thereby releasably fastened to the loop material at continuously variable positions on a length of loop material so as to adjustably fit the strap on a variety of wearers of different sizes; and elongated left and right shoulder straps respectively attached at one end to the body strap at equal lateral distances outwardly from outer sides edges of the respective left and right breast cups, the shoulder straps being positioned such that when the brassiere is fitted on a wearer, each shoulder strap is positioned to extend from the wearer's back over one of the shoulders of the wearer and then through one of the shoulder strap attachment rings at the upper edges of the breast cups, the shoulder straps having hook and loop fastener material thereon at spaced locations therealong, with loop material extending for an elongated portion of the shoulder strap and hook material being located toward a second end of the shoulder strap, such that when the shoulder straps are extended through the shoulder strap attachment rings and folded back against themselves, the hook material is engaged with and thereby releasably fastened to the loop material at continuously variable positions on a length of loop material so as to thereby adjustably fit the shoulder straps on a variety of wearers of different sizes.

2. The brassiere of claim 1 wherein the shoulder strap attachment rings include O rings.

3. The brassiere of claim 1 wherein the body strap attachment ring comprises two flattened O rings fixedly attached to each other on their flat sides to provide first and second openings, the third section of the back strap extending through the first opening and being in fixed attachment to the O ring, the second section of the back strap extending through the second opening in the O ring and being adjustably and releasibly attached to the O ring by the hook and loop fastener material on the second section.

4. The brassiere of claim 1 wherein the shoulder straps comprise hook and loop material that does not stretch.

5. The brassiere of claim 1 wherein the first section of the back strap comprises stretchable material.

6. A brassiere as in claim 1, wherein the brassiere is separable at a position adjacent the cups, the brassiere having opposed inner side edges at the position where the brassiere is separable, the inner side edges being releasably connected together by releasable fasteners, the brassiere being installable and removable from the front of the brassiere without releasing the hook and loop fastener material on the body strap by engaging and disengaging the releasable fastener that joins the opposed inner side edges.

7. A brassiere as in claim 6 wherein the releasable fasteners comprise a zipper positioned between the breast cups that fastens the brassiere in place on the wearer by zipping and then removing the brassier from the wearer by unzipping a front of the brassiere and without the necessity of unfastening and refastening the hook and loop fastener material on the body strap once the body strap length has been fittingly adjusted to thereby fit the person wearing the brassiere.

* * * * *